United States Patent [19]

Sugihara et al.

[11] Patent Number: 5,063,945

[45] Date of Patent: Nov. 12, 1991

[54] TOBACCO FILTER STOCK

[75] Inventors: Taizo Sugihara, Oumihachiman; Hiromu Sonoda, Shiga; Kiyonori Shiiba, Moriyama, all of Japan

[73] Assignee: Chisso Corporation, Ohsaka, Japan

[21] Appl. No.: 500,574

[22] Filed: Mar. 28, 1990

[30] Foreign Application Priority Data

Mar. 31, 1989 [JP] Japan ..... 1-82136

[51] Int. Cl.[5] ..... A24D 3/02; A24D 3/06; B32B 3/00; D02G 3/00

[52] U.S. Cl. ..... 131/332; 493/42; 493/50; 428/370; 428/394; 428/400

[58] Field of Search ..... 131/331, 332, 343, 344, 131/345; 493/42, 50; 428/370, 394, 400

[56] References Cited

U.S. PATENT DOCUMENTS 4,546,040 10/1985 Knotek et al. .

*Primary Examiner*—V. Millin

*Attorney, Agent, or Firm*—Fay, Sharpe, Beall, Fagan, Minnich & McKee

[57] ABSTRACT

A tobacco filter stock capable of being molded into a filter only be entanglement of filaments with one another without any adhesion means, whereby the resulting filter has a suitable hardness and a superior whiteness. A tobacco filter and a production process thereof are provided, whereby the tobacco filter stock comprises a ton of crystalline polyolefin filaments, preferably crystalline polypropylene filaments, having a single filament denier of 1 to 6 d/f, a total denier of 30,000 to 60,000 D 40 to 60 crimps/25 mm filament, a crimp elastic modulus of 2.5 to 5.0, a frictional coefficient between filaments of 0.20 to 0.37 and a height ratio (height/-width) of 0.01 to 0.1.

6 Claims, No Drawings

TOBACCO FILTER STOCK

BACKGROUND OF THE INVENTION

1. Field of the Invention

This invention relates to a tobacco filter stock. More particularly, it relates to a tobacco filter stock formed using a tow of crystalline polyolefin filaments, and a process for producing a tobacco filter which comprises applying the stock to a tobacco filter paper winder to mold the stock into a tobacco filter without use of any adhesion means such as adhesives, hot-melt adhesion, etc.

2. Description of the Related Art

As the stock for tobacco filters, cellulose triacetate filaments have been generally used, and paper winders themselves for tobacco filter-producing machines have generally been unified into those for cellulose triacetate filaments. On the other hand, as a filament stock in place of cellulose triacetate filaments, polyolefin filaments, particularly polypropylene filaments, have been proposed mainly because of cost, and have been practically used in part (Japanese patent application laid open No. Sho 61-247368/1986, U.S. Pat. No. 4,546,040, Japanese patent publication No. Sho 55-402315/1980, etc.). As an example of the process for producing a tobacco filter using polypropylene filaments, a tow having a total denier of about 40,000 to 60,000 is passed through a filaments opening machine using air or steam to subject it to opening treatment; the bundling of the tow is improved by adding a suitable binder or hot-melt adhesion; the resulting tow is fed, onto a paper winder as a tobacco filter-producing machine; a paper is wound around the tow while molding the tow into a rod form and solidifying the resulting material to obtain a product (Japanese patent application laid-open No. Sho 61-247368/1986). This process however, has raised various problems such as the necessity of filament binders and an adhesion step environmental pollution due to solvents of the binders, inferior processability, high cost, etc. Further, U.S. Pat. No. 4,546,040 discloses a process for producing a tobacco filter stock by stretching a sliver consisting of 3,000 to 10,000 multifilaments of polyolefin conjugate fibers having three-dimensional crimps (5 to 7 crimps/cm) at a temperature of 15° to 70° C. During the above-mentioned stretching of the fibers, fine voids and micropores are formed. The sliver is annealed at 70° to 140° C., followed by winding a paper thereon by means of a filter paper winder and cutting the resulting material to a predetermined length to obtain a product. However, the tobacco filter produced using such a sliver of polyolefin conjugate fibers having three-dimensional crimps has the so-called cavities (vacant parts) in spite of a heavy basis weight (weight per unit cross-section area), an insufficient hardness and an inferior whiteness; hence only a product having a considerably low commercial value can be produced.

Further, the above-mentioned Japanese patent publication No. Sho 55-402315/1980 also discloses a process for producing a tobacco filter by subjecting two or more kinds of components having different melting points to conjugate spinning to prepare polyolefin filaments having a latent crimp, and subjecting the filaments to heat-treatment at a temperature between the melting points of both the components to subject these filaments to self-adhesion by hot-melt adhesion to one another thereby stabilizing the resulting filament bundle. However, because the process requires a treatment step of hot-melt adhesion, the resulting tow has a heavy basis weight like the above-mentioned one and the production rate is very low.

Further, heretofore when a tobacco filter or the like has been produced using polyolefin filaments in 100% by weight without any adhesive, the resulting product has had a lower Young's modulus than that of cellulose triacetate filaments. Thus, there have been drawbacks in that it is inferior as to the hardness of the tobacco filter. Further, a number of falling filaments due to non-adhesion and cavities in the tobacco filter are likely to occur, and the resulting filter has a very uneven whiteness.

SUMMARY OF THE INVENTION

The object of the present invention is to provide a tobacco filter stock overcoming the above-mentioned drawbacks of the prior art and consisting of crystalline polyolefin filaments capable of being molded into a filter without any adhesion means such as adhesives, hot-melt adhesion, etc., whereby the resulting filter has a suitable hardness and a superior whiteness. A process for producing a tobacco filter using the tobacco filter stock is also an object of the present invention.

The present invention in a first respect resides in a tobacco filter stock comprising a tow of crystalline polyolefin filaments having a single filament denier of 1 to 6 d/filament, a total denier of 30,000 to 60,000 D, 40 to 60 crimps/25mm filament, a crimp elastic modulus of 2.5 to 5.0, and a frictional coefficient between filaments of 0.20 to 0.37, and a height ratio (height/width) of 0.01 to 0.1.

The present invention in a second respect resides in a process for producing a tobacco filter which comprises feeding a tow in the form of the above-mentioned tobacco filter stock onto a general tobacco filter paper winder to mold the tow into a filter by entanglement of the filaments without use of a binder.

DETAILED DESCRIPTION OF PREFERRED EMBODIMENTS

Examples of the crystalline polyolefin used in the present invention are polyolefins having fiber-forming capability such as crystalline polypropylene, crystalline polyethylene, crystalline propylene-ethylene copolymer, etc. Among these, a crystalline polypropylene is preferred. Particularly a crystalline polypropylene having a density of 0.905 or higher, an isotactic pentad ratio of boiling n-heptane-insoluble portion of 0.950 or higher, and a pentad ratio having two different configurations, of 0.002 or lower, is preferred. The isotactic pentad ratio referred to herein means an isotactic ratio in terms of pentad units in a polypropylene molecular chain, measured according to a method announced by A. Zambell et al in Macromolecules 6, 925 (1973) i.e. using $^{13}$C-NMR Thus, the isotactic pentad ratio refers to a ratio of propylene monomer units consisting of five continued, isotactically bonded propylene monomer units. Further, the pentad ratio having two kinds of configurations refers to a pentad ratio such that among the configurations of the five monomer units in the molecular chain, three of the units have common configurations and the other two thereof have configurations contrary thereto. When this polypropylene is used, the resulting tow has high stiffness, so that it is possible to easily obtain a tobacco filter satisfying various physical properties required in the present invention.

The above polypropylene can be produced by polymerizing propylene in the presence of a catalyst prepared by reacting an organoaluminum or a reaction product of an organoaluminum compound with an electron donor, with $TiCl_4$ to obtain a solid product (I), further reacting an electron donor and an electron acceptor with the solid product (I) to obtain a solid product (II), and combining the product (II) with an organoaluminum compound and an aromatic carboxylic acid ester (III), the molar ratio (III/II) of the aromatic carboxylic acid ester (III) to the solid product (II) being made 0.2 to 1.00 (Japanese patent application laid-open No. Sho 58-104907).

The present invention will be described in reference to a case using a crystalline polypropylene (hereinafter referred to merely as polypropylene) as the representative example of polyolefins.

In the preparation of a tow from the above polypropylene, polypropylene is melt-spun in a conventional manner, followed by arranging the resulting unstretched filaments (tow) while avoiding crossing of filament bundles with one another to the utmost, stretching them to 2.0 to 6.0 times the original length at 15° to 40° C., feeding the resulting stretched tows into a stuffer type crimper to afford uniform zigzag crimps, and if necessary, subjecting the resulting crimped bundles to heat setting, to obtain a tow. The above stretching step can be omitted according to a certain spinning process, for example by making the take-up speed higher.

When the stretched tows are fed from the stretching machine into a crimper, it is preferred that the stretched tows are arranged so as to prevent entanglement thereof from one another to the utmost. If entanglement of the stretched tows occurs in advance of feeding them into the crimper, a locally unopened part results when the tows are opened by a paper winder, thereby causing a density unevenness.

The crimped tow used in the present invention has 40 to 60 crimps/2.5 cm, preferably 45 to 60 crimps/2.5 cm. The number of crimps is extraordinarily large as compared with 15 to 25 crimps/2.5 cm of cellulose triacetate filaments for tobacco filters.

If the number of crimps does not reach 40, the opening properties of the tow are inferior and when the tow is fed to a high-speed paper winder, no opening in a necessary short time can be obtained. If the number exceeds 60, a high pressure is required for the crimper at the time of crimping, problems such as melt-adhesion of filaments, etc. are likely to occur; hence such an excess number is not practical. Further, the crimp form in the crimped tow is a two-dimensional crimp of zigzag type having an acute angle. If it is a three-dimensional crimp such as a spiral crimp, it is difficult to obtain suitable hardness, basis weight, etc. for tobacco filters.

Further the crimp elastic modulus of the tow, i.e. the ratio of a length of the tow (A) as measured when a load per 2 mg/d is imparted to the tow, to a theoretical length of the tow (B) (a length of the tow supposed to have no crimp) is 2.5 to 5.0, preferably 3.0 to 4.0. If this value is less than 2.5, the stiffness of the tow is inferior and it is impossible to obtain a filter having a suitable hardness, while if it exceeds 5.0, it is difficult to impart a zigzag crimp of an acute angle to have a limitation in the aspect of production.

As a crimper for imparting the above-mentioned high crimp, it is preferred that the crimper have a box of a shallow and long shape (i.e. the height ratio (height/width) of the opening part of the box should be 0.01 to 0.1 and the ratio of the width to the depth of the box should be 0.1 to 2.5). The stuffing pressure is preferably 2.0 to 4.0 kg/cm$^2$.

Further, the frictional coefficient between filaments of the crimped tow used in the present invention is preferably 0.20 to 0.37. If the frictional coefficient is less than 0.20, the high-speed opening properties are inferior, whereas if it exceeds 0.37, crimping is likely to be uneven.

The oiling agent should be suitably chosen so that the above-mentioned frictional coefficient between filaments satisfies the above-mentioned specified range when the tow is fed to the crimper.

The height ratio of the crimped tow used in the present invention (height/width of the cross-section in the direction of the tow width) is in the range of 0.01 to 0.1. When such a very thin and broad width tow is used, it is possible to open the tow instantaneously by a high-speed paper winder as described later. If the height ratio is less than 0.01, the tow is too thin thereby after making the density uneven, while if it exceeds 0.1, the filament density is too high to correspond to the specifications applied to tobacco filters. The denier of the crimped tow as a product is preferably 1 to 6 d/f in terms of a single filament and 30,000 to 60,000 D, particularly 35,000 to 50,000 D, in terms of the total denier.

In the production of tobacco filters using the above crimped tow, for example, the above crimped tow is fed to a high-speed paper winder such as a conventional machine for producing cellulose triacetate tobacco filter, followed by an opening step, tow bundling step, paper winding step and cutting step. In this production, application step and drying step etc. of adhesive employed in conventional filter productions are unnecessary. As for the high-speed winder for producing tobacco filter, those disclosed in Japanese patent applications laid-open Nos. Sho 61-247368/1986 and 54-46900/1979, Japanese patent publication No. Sho 61-39032/1986, etc. are employed.

The crimped tow used in the present invention has a high density, far superior bundling properties without any adhesive, and a large number of crimps having an acute angle edge, as described above; hence the tow is instantaneously opened by means of a simple opening machine provided along with a high-speed paper winder. It also has a low basis weight and a high bulkiness even without using any adhesive at the time of tow-collecting molding, so it is possible to form a tobacco filter having a low air-filtration resistance and a suitable hardness.

Since the crimped tow used in the present invention has a crimp elastic modulus within the above-mentioned specified range, it has tow-bundling properties and a crimp-retainability capable of enduring, high-speed winding such as 200 to 600 m/min. used during the production of tobacco filters. Further, since the tow used is obtained at a low stretching temperature and has a large number of crimps, the resulting tobacco filter has a high whiteness and a superior gas-adsorptivity as described later.

According to the present invention, it is possible to form a tobacco filter having a very large number of crimps, a superior bulkiness and a high performance without any adhesive at a high speed. Further, since the micro spaces in this filter are uniform and formed in an enormous number, the percentage adsorption of nicotine, tar, etc. is very high in spite of a low air-filtration resistance.

In regard to the air-filtration resistance and gas adsorptivity, the tobacco filter of the present invention was compared with a typical cellulose triacetate tobacco filter. The results are as follows:

TABLE 1

| | Tobacco filter according to the present invention | Acetate filter |
|---|---|---|
| Air-filtration resistance | 60–63 mm $H_2O$ | 65 mm $H_2O$ |
| Nicotine adsorption | 40–43% | 38–40% |
| Tar adsorption | 35–37% | 33–35% |

The present invention will be described in more detail by way of Examples and a Comparative example, but it should not be construed to be limited thereto.

The measurement methods and the definitions of the values of physical properties used in the Examples are shown below.

Density:

Samples were prepared according to the press method of JIS K-6758, and measured according to the density gradient tube method of JIS K-7112.

Boiling n heptane-insoluble portion of polypropylene:

Polypropylene (5 g) was totally dissolved in boiling xylene (500 ml), followed by feeding the resulting solution in methanol (5 l), recovering the resulting deposits, drying them and subjecting them to Soxhlet extraction with boiling n-heptane for 6 hours. The captioned insoluble portion refers to the resulting extraction residual portion.

Isotactic pentad ratio (Po) and pentad ratio having two different configurations ($P_2$):

With a boiling n-heptane-insoluble portion of polypropylene, an isotactic pentad ratio (Po) was measured according to the method described in Macromolecules 6, 925 (1973). The method of determining the attribution of peaks in the measurement of NMR was based on the above Macromolecules 8, 687 (1975). This measurement by means of NMR was carried out by using a device of 270 $MH_3$ of FT-NMR, and raising the signal detection limit up to 0.001 in terms of the isotactic pentad ratio by 27,000 times integration measurements.

MFR: according to the condition (L) of ASTM D 1238.

Frictional Coefficient: according to Roder Method.

Crimp Elastic Modulus:

One meter of tow was taken from a sample tow having a nominal total denier of (b), and its weight (c) was measured. The tow was hung with a weight of 2b mg at its lower end, and the length (A) of the tow was measured. Theoretical length of the tow (B) was calculated by the following equation:

$$B=9{,}000\times c/b$$

Crimp Elastic Modulus (M) was calculated by the following equation:

$$M=B/A$$

Height Ratio:

A tow of 30 cm in length was put on a plate, and a transparent (Plastic) plate having a dimensions of 30 cm 30 cm and weight of 25 g was put on the tow, then the height (h) and the width (w) of the tow were measured. Height ratio (R) is calculated as follows;

$$R=h/w$$

Number of Crimps

Specimen was subjected to pre-tention of 2 mg per 1 denier of nominal denier, then the number of crimps between 25 mm were measured.

Example 1

An isotactic polypropylene having an MFR of 30 and a density of 0.910 ($P_0$: 0.935, $P_2$: 0.018) was melt-spun at a spinning temperature of 280° C. and at a spinning rate of 700 m/min. to prepare unstretched filaments of 10.5 d/f, followed by arranging them while preventing crossing of filament bundles with one another to the utmost, stretching them to 3.5 times the original length at a roll temperature of 30° C., feeding the stretched materials into a stuffer-type crimper having a roll width (inlet width) of 60 mm, a box height of 30 mm and a box depth of 180 mm to impart crimps under a pressure of 2.5 kg/cm$^2$ to obtain a crimped polypropylene tow having a total denier of 32,000 D (single filament denier: 3.0 d/f). This tow had a crimp elastic modulus (B)/(A) of 3.0, a height ratio of 0.046 (width: 6.0 mm, height: 2.8 mm) and uniform zigzag crimps of 42 crimps/25 mm having an acute angle edge.

The thus obtained tow was fed to a paper winder used for conventional tobacco filter at a rate of 4,000 rpm, and subjected to steps of opening, paper-winding and cutting to form a filter plug having a rod shape of 102 mm. At that time, an adhesive like triacetin etc. used in the case of a conventional filter was not used and steps therefor were omitted.

The specifications of the resulting filter plug are shown in Table 2. Further, the filter was joined to a cigarette and an adsorption test was carried out. The results are shown in Table 3.

TABLE 2

| | |
|---|---|
| Length | 102 mm |
| Circumference | 24.60 mm |
| Weight | 0.7 g |
| Appearance | Right circular; wrinkles, cut edge and hardness are all good. |

TABLE 3

| | |
|---|---|
| Filter length | 17 mm |
| Nicotine adsorption | 43% |
| Tar adsorption | 35% |
| Air-filtration resistance | 61 mm $H_2O$ |

Since the tobacco filter obtained according to the above Example was made of well-entangled, highly crimped and well-opened filament, the filter caused no filament falling, had a high whiteness and had good aromatic taste when used; hence it was very excellent as a tobacco filter.

Example 2

An isotactic polypropylene ($P_0$: 0.919, $P_2$: 0.025) having an MPR of 25 and a density of 0.902 was melt-spun at a spinning temperature of 300° C. and at a spinning rate of 600 m/min. to prepare unstretched filaments of 12 d/f, followed by arranging them while preventing crossing of filament bundles with one another to the utmost, stretching them to 3.0 times the original length at a roll temperature of 50° C., feeding the stretched materials into a stuffer-type crimper having a roll width of 40 mm, a box height of 15 mm and a box depth of 140 mm and imparting crimps under a pressure of 3.6 kg/cm$^2$ to obtain a crimped tow having a total denier of 35,000 D (a single filament denier: 4.0 d/f). This tow had a crimp elastic modulus (B)/(A) of 4.0, a height ratio of 0.053 (width: 40 mm, thickness 2.1 mm) and uniform zigzag crimps of 50 crimps/25 mm having an acute angle edge.

The thus obtained tow was fed to a paper winder used for conventional tobacco filter at a speed of 4,000 r.p.m., and subjected to steps of opening, paper-winding and cutting to form a filter plug having a rod shape of 102 mm. At that time, an adhesive like triacetin etc. used in the case of conventional filter was not used and these steps were omitted.

The specifications of the resulting filter plug are shown in Table 4. Further, the filter was joined to a cigarette and an adsorption test was carried out. The results are shown in Table 5.

TABLE 4

| | |
|---|---|
| Length | 102 mm |
| Circumference | 24.80 mm |
| Weight | 0.73 g |
| Appearance | Right circular; wrinkles, cut edge and hardness are all good. |

TABLE 5

| | |
|---|---|
| Filter length | 17 mm |
| Nicotine adsorption | 44% |
| Tar adsorption | 37% |
| Air-filtration resistance | 65 mm $H_2O$ |

Comparative example 1

Example 1 was repeated except that a stuffer-type crimper having a box height of 70 mm and a box depth of 150 mm was used, to obtain a crimped tow. This tow had a total denier of 32,000 D (a single filament denier 3.0 d/f), a crimp elastic modulus (B)/(A) of 2.0, a height ratio of 0.133 (width: 60 mm, height: 8 mm) and zigzag type crimps of 28 crimps/25 mm. This tow was fed onto a tobacco filter paper winder in the same manner as in Example 1 to obtain a filter plug of 102 mm.

As to this filter plug, it was found that the circumference was only 23.90 mm, and that the plug did not have a hardness required for a tobacco filter. Further, the cut edge of the filter had a large unevenness of whiteness (corresponding to dull color) and was likely to cause filament falling; thus, it was unsuitable as a tobacco filter.

Example 3

A polypropylene ($P_0$: 0.964, $P_2$: 0.002 or less) having a MFR of 30 and a density of 0.913, disclosed in Japanese patent application laid-open No. Sho 63-1355495/1988 was spun at a spinning temperature of 280° C. and at a spinning rate of 700 m/min. to prepare unstretched filaments of 10.5 d/f, followed by arranging the filaments while preventing crossing of filament bundles with one another to the utmost, stretching them to 3.5 times the original length at a roll temperature of 30° C., feeding the stretched filaments to a stuffer-type crimper having a roll width of 60 mm, a box height of 30 mm and a box depth of 180 mm and imparting crimps under a pressure of 3.0 kg/cm$^2$, to obtain a crimped polypropylene tow having a total denier of 31,000 D (a single filament denier: 3.0 d/f). This tow had a crimp elastic modulus (B)/(A) of 3.0, a height ratio of 0.046 (width: 60 mm, height: 2.8 mm) and uniform zigzag crimps of 42 crimps/2.5cm having an acute angle edge.

The thus obtained tow was fed to a paper winder used for conventional tobacco filter, at a rate of 4,000 r.p.m., and subjected to steps of opening, paper-winding and cutting to form a filter plug having a rod shape of 102 mm. At that time, an adhesive like triacetin etc. used in the case of a conventional filter was not used and these steps were omitted.

The specifications of the resulting filter plug are shown in Table 6. Further, the filter was joined to a cigarette and an adsorption test was carried out. The results are shown in Table 7.

TABLE 6

| | |
|---|---|
| Length | 102 mm |
| Circumference | 24.60 mm |
| Weight | 0.68 g |
| Appearance | Right circular; wrinkles, cut edge and hardness are all good. |

TABLE 7

| | |
|---|---|
| Filter length | 17 mm |
| Nicotine adsorption | 45% |
| Tar adsorption | 37% |
| Air-filtration resistance | 58 mm $H_2O$ |

According to this Example, since a polypropylene having a high stiffness (high crystallization degree) was used, a tobacco filter having an improved bulkiness, a light weight, a high filter hardness and a high whiteness was obtained. Further, when this raw material is used, such a remarkable effectiveness is obtained that the opening properties of tow are improved and when the tow is formed into a filter, the quantity of nicotine and tar adsorbed is improved.

What we claim is:

1. A tobacco filter stock, for use in the production of a tobacco filter, said tobacco filter stock comprising:

a tow of crystalline polyolefin filaments having a single filament denier of 1 to 6 d/filament;

a total denier of 30,000 to 60,000 D 40 to 60 crimps/25 mm filament;

a crimp elastic modulus of 2.5 to 5.0; and a frictional coefficient between filaments of 0.20 to 0.37, and a height ratio (height/width) of 0.01 to 0.1.

2. The tobacco filter stock according to claim 1, wherein said polyolefin is a polypropylene.

3. The tobacco filter stock according to claim 1, wherein said crystalline polyolefin is a crystalline polypropylene having a density of 0.905 or higher; an isotactic pentad ratio of boiling n-heptane-insoluble portion of 0.950 or higher; and a pentad ratio having two different configurations of 0.002 or lower.

4. The tobacco filter stock according to claim 1, wherein said tobacco filter stock is produced by a process comprising the steps of:

melt-spinning polyolefin into bundles of unstretched filaments to obtain unstretched tow;

stretching the unstretched tow to 2.0 to 6.0 times the original length at 15° to 40° C. to obtain stretched tow; and feeding the stretched tow into a stuffer-type crimper having a crimper box which has a height ratio of 0.01 to 0.1 and a ratio of the width to the depth of 0.1 to 2.5.

5. A process for producing a tobacco filter which comprises:

feeding the tobacco filter stock as set forth in claim 1 onto a tobacco filter paper winder to mold the tobacco filter stock into a filter by an interlacing of filaments with one another without any adhesion means.

6. The tobacco filter produced according to the process set forth in claim 5.

* * * * *